US008646608B2

(12) United States Patent
Struthers et al.

(10) Patent No.: US 8,646,608 B2
(45) Date of Patent: Feb. 11, 2014

(54) PACKAGING AND DISPLAY DEVICE

(75) Inventors: Kenneth Clarke Struthers, Hixson, TN (US); Kevin McElvain, Stillwater, MN (US); John Robert Flanyak, Glen Ellyn, IL (US)

(73) Assignee: Ferrara Candy Company, Oakbrook Terrace, IL (US)

( * ) Notice: Subject to any disclaimer, the term of this patent is extended or adjusted under 35 U.S.C. 154(b) by 0 days.

(21) Appl. No.: 12/610,088

(22) Filed: Oct. 30, 2009

(65) Prior Publication Data

US 2011/0100867 A1 May 5, 2011

(51) Int. Cl.
*B65D 73/00* (2006.01)

(52) U.S. Cl.
USPC ..... 206/485; 206/476; 206/562; 206/780; 426/392

(58) Field of Classification Search
USPC ..... 206/485, 443, 526, 564, 422, 365, 332, 206/380, 476, 486–490, 562, 563, 277, 426, 206/780, 799; 211/13; 426/104, 119, 660, 426/392
See application file for complete search history.

(56) References Cited

U.S. PATENT DOCUMENTS

| | | | | | |
|---|---|---|---|---|---|
| 1,755,234 | A | * | 4/1930 | Westerfield | 206/443 |
| 4,158,408 | A | | 6/1979 | Thiessen | |
| 4,450,965 | A | * | 5/1984 | Paillet | 206/528 |
| 5,474,171 | A | * | 12/1995 | Niesen et al. | 206/765 |
| 5,505,309 | A | * | 4/1996 | Taravella et al. | 206/485 |

OTHER PUBLICATIONS

Smartie 6-inch candy canes (before/on Dec. 3, 2008) http://blog.sweetservices.com/sweetcandyblog/2008/12/smartie-6inch-candy-canes.html.*

* cited by examiner

*Primary Examiner* — J. Gregory Pickett
*Assistant Examiner* — Raven Collins
(74) *Attorney, Agent, or Firm* — Merchant & Gould PC

(57) ABSTRACT

A packaging system includes a tray that supports candy canes in a side-by-side presentation while maintaining the candy away from the outer walls of the packaging. A template of cardboard stock is cut and folded to define a candy can support tray that is covered by a transparent wrapper or inserted into a box. The tray includes a bottom base and sides that are folded upward and end portions that fold inward with tabs align to create the rectangular tray with an open top. A first end of the tray includes a portion extending downward from the top edge to the base at an oblique angle with orifices receiving ends of the candy canes. At an opposite end of the tray, a second support portion has a portion extending downward at an oblique angle from the end wall to the base of the tray. The angled support portion includes two sets of orifices, one above another aligned so that the candy canes insert with the straight portion inserting through the orifice at the second end into a corresponding orifice in the first end and the hook portion of the candy cane inserting into the top orifice at the second end. The second end also includes a loading window aligned so that the candy canes slide longitudinally through each of the orifices. The tray supports the candy canes in a position that minimizes breakage during shipment and provides a pleasing presentation to customers.

8 Claims, 9 Drawing Sheets

PACKAGING AND DISPLAY DEVICE

BACKGROUND OF THE INVENTION

1. Field of the Invention

The present invention is directed to a package for candy canes formed from a sheet of material that suspends candy canes away from outer walls of a box.

2. Description of the Prior Art

Many types of packaging have been developed for holding breakable articles during shipment. Some packaging may also allow for displaying the articles while in the packaging. It can be appreciated that without padding or structure to maintain the breakable articles away from walls of the outside of the packaging, the articles may become damaged during shipping.

Packaging should be lightweight, recyclable and made from readily available materials so that the packaging is inexpensive to manufacture. Packaging should also provide for displaying the articles in a pleasing manner that increases attraction of the product for potential purchasers.

Certain types of articles are more difficult to display and ship while minimizing breakage. Candy Canes for example, have a hook type end portion. Maintaining such articles away from the walls can be a particular challenge. Moreover, to display the articles in a pleasing manner, it is preferable to position the articles aligned in parallel side by side. Such a configuration also increases the density of the articles, thereby reducing the material needed for the package. In addition to maintaining the articles in such alignment, the insertion of the articles into the packaging may be time consuming and labor intensive. Packaging should reduce the time and labor required to fill the packages.

Prior packaging devices for such articles are shown for example in U.S. Pat. No. 4,158,408 to Thiessen. Although the Thiessen device provides a degree of protection against the articles, it can be appreciated that the packaging is able to display only a low number of the articles. A low packing density is achieved. Moreover, the articles cannot be displayed in a side-by-side arrangement. In addition, each of the articles must be individually inserted into a molded tray configured for accepting the candy canes. This requires individual insertion and alignment of each article. Furthermore, the candy canes may not be suspended a sufficient distance from the walls to protect them during shipping so that breakage may continue to be a concern.

It can be seen that a new and improved packaging and display device is needed. Such a device should provide for inexpensive manufacture and loading of the packaging and easy loading of the articles. Moreover, the packaging provide for loading articles quickly in a side-by-side configuration and provide for loading more than one article at a time. Once loaded, the packaging should provide for maintaining the articles in a spaced apart relationship to the outer walls of the packaging. The present invention addresses these as well as other problems associated with packaging for breakable articles.

SUMMARY OF THE INVENTION

The present application is directed to a packaging system and in particular, a packaging system for supporting candy canes. The packaging system includes a tray that supports candy canes in a side-by-side presentation while maintaining the candy away from the outer walls of the packaging.

A template of cardboard stock, for example, is cut and folded to define a candy can support tray that is covered by a transparent wrapper. The tray may also insert into a rectangular box. The tray includes a bottom base and sides that are folded upward. End portions fold inward and tabs align to create the rectangular tray. A first end of the tray includes a portion extending downward from the top edge to the base at an oblique angle. Orifices are formed in the end portion configured to receive ends of the candy canes. At an opposite end of the tray is a second support portion having a portion extending downward at an oblique angle from the end wall to the base of the tray. The angled support portion includes two sets of orifices, one above another. The orifices are aligned so that the candy canes insert with the straight portion inserting through the orifice at the second end into a corresponding orifice in the first end and the hook portion of the candy cane inserting into the top orifice at the second end. The second end also includes a loading window that is aligned so that the candy canes may be slid longitudinally through each of the orifices. The orifices maintain the candy canes in a spaced apart relationship to the front and rear walls and sides of the box. Moreover, the tray forms an open top so that the candy canes are visible through a window in the box.

The packaging system provides for quick and inexpensive manufacture. Moreover, the candy canes may be quickly loaded into the packaging. The packaging further maintains the candy canes in a supported position that minimizes breakage during shipment. The candy canes are supported to provide a pleasing presentation to potential customers.

These features of novelty and various other advantages that characterize the invention are pointed out with particularity in the claims annexed hereto and forming a part hereof However, for a better understanding of the invention, its advantages, and the objects obtained by its use, reference should be made to the drawings that form a further part hereof, and to the accompanying descriptive matter, in which there is illustrated and described a preferred embodiment of the invention.

DETAILED DESCRIPTION OF THE PREFERRED EMBODIMENT

Figure 1:
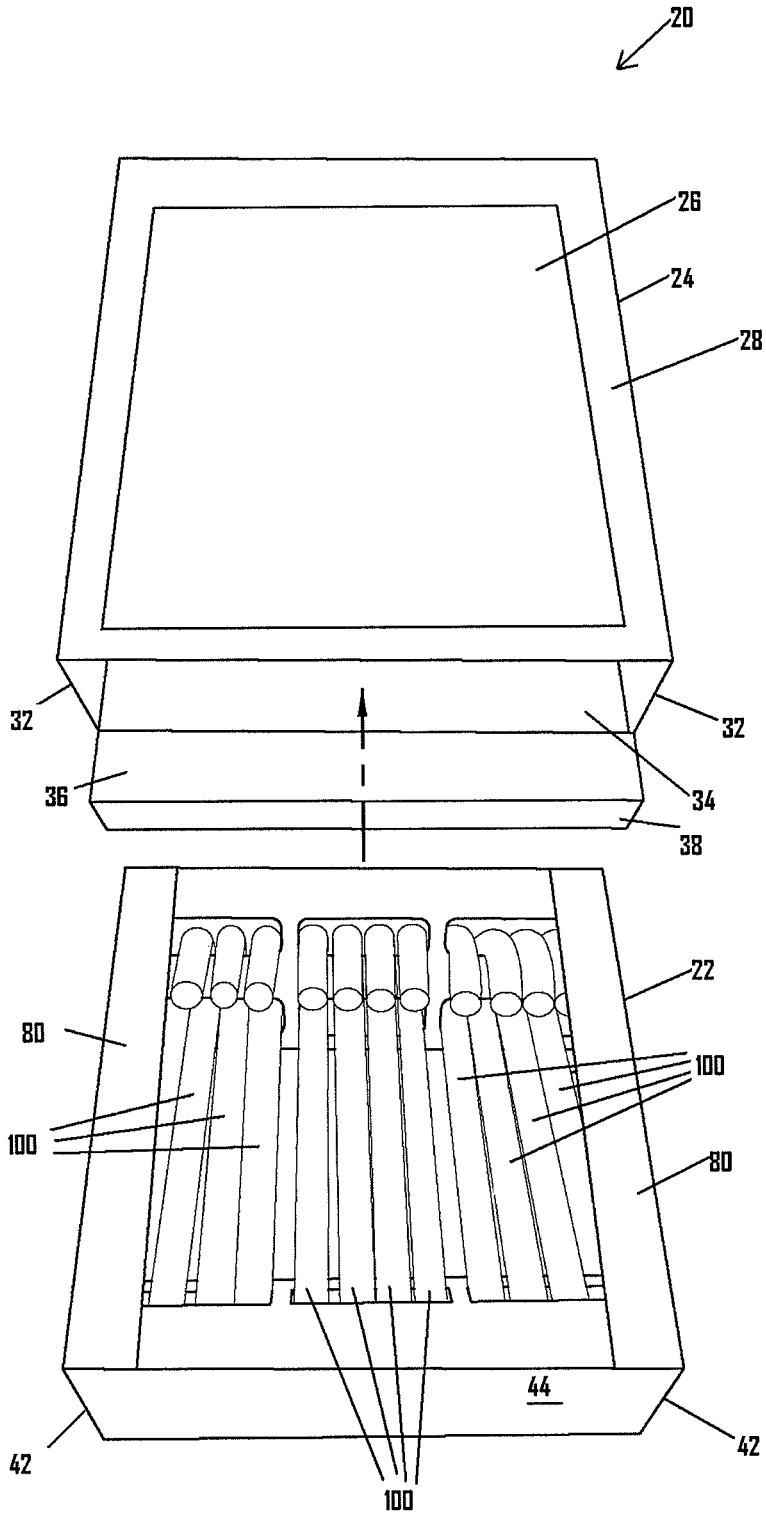
FIG. 1 is a perspective view of packaging according to the principles of the present invention.
Figure 2:
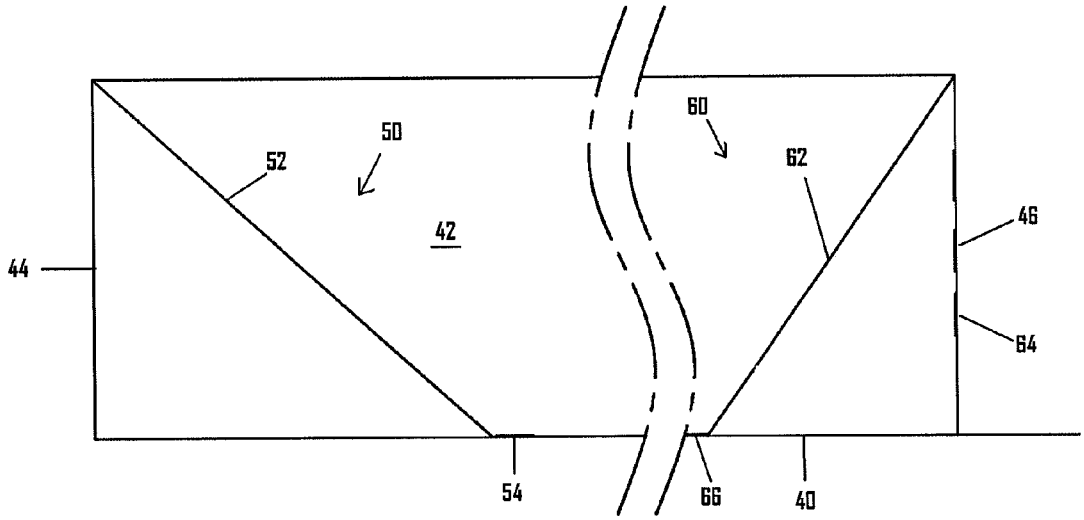
FIG. 2 is a side sectional view of a first embodiment of a tray for the packaging shown in FIG. 1 with the tray empty.
Figure 3:
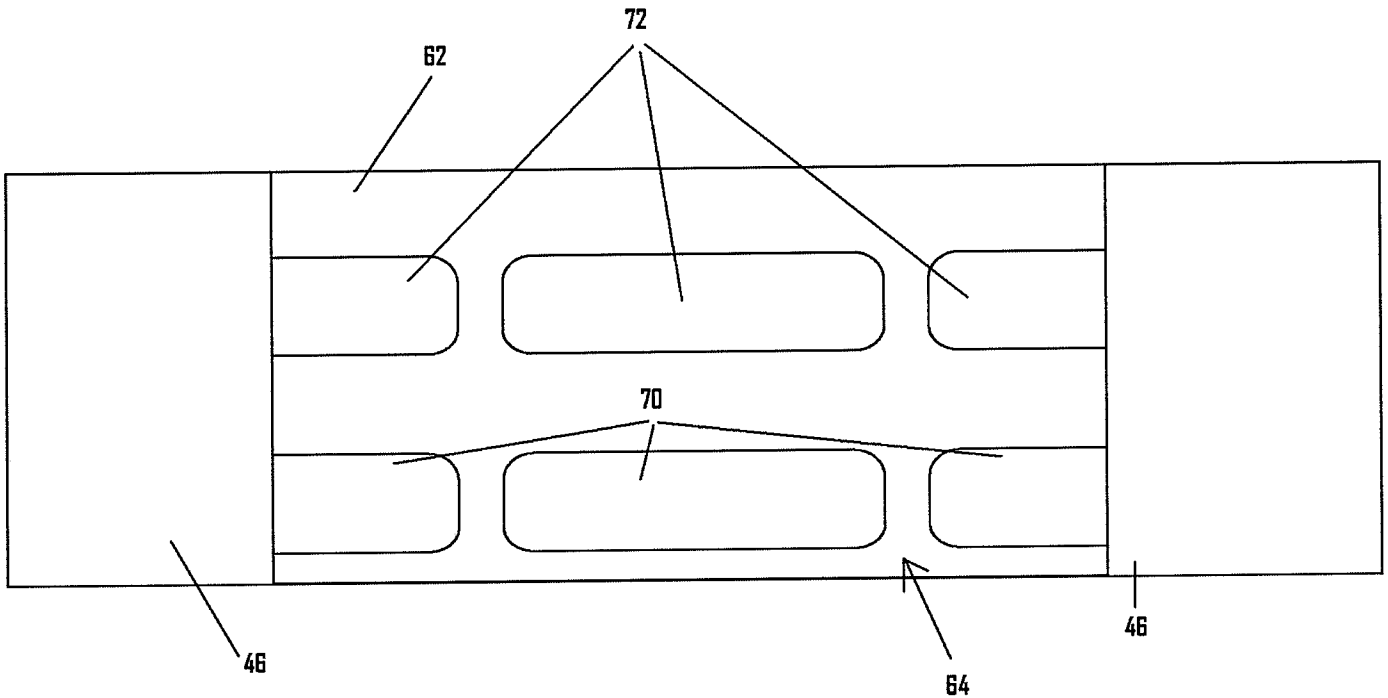
FIG. 3 is an end elevational view of the tray shown in FIG. 2.
Figure 4:
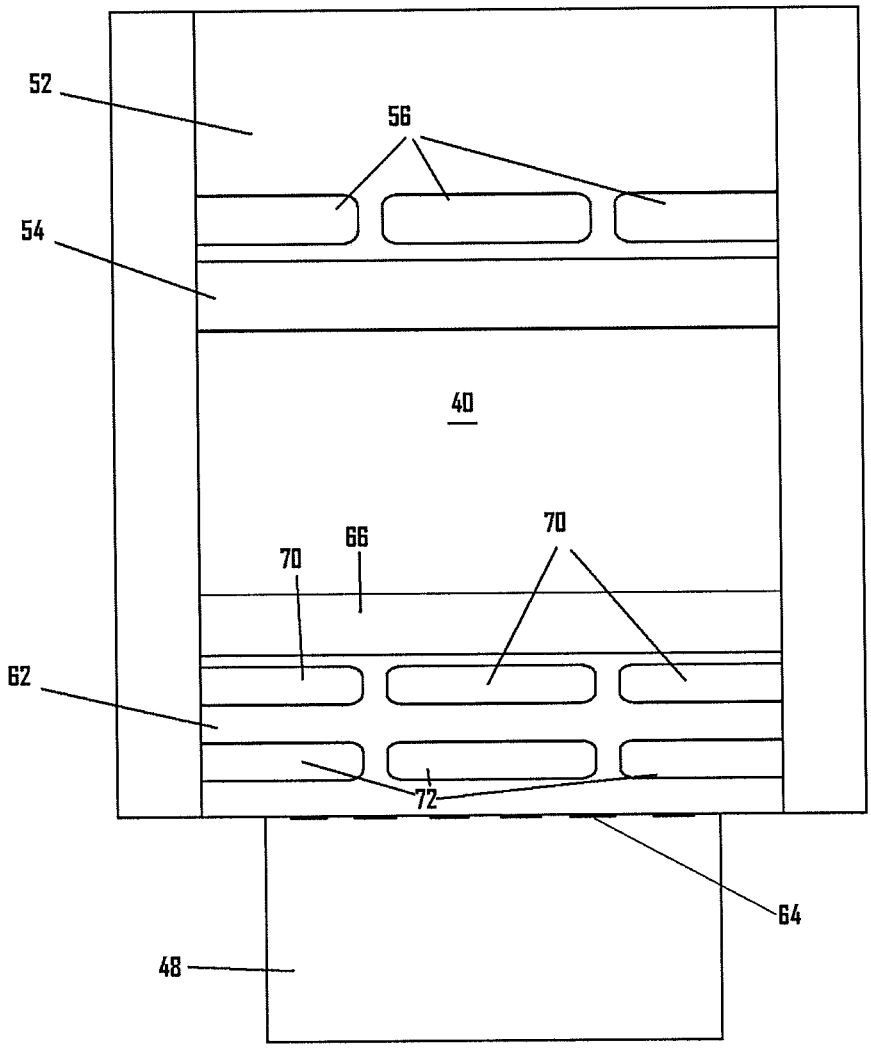
FIG. 4 is a top plan view of the tray shown in FIG. 2.

Referring to the drawings, and in particular FIG. 1, there is shown packaging, generally designated 20. The packaging 20 is particularly configured for supporting candy canes 100. The packaging 20 includes a tray 22 inserting into a box 24. In another embodiment, the box is replaced by a film or other conventional transparent wrapper extending over the exterior of the tray 22. In one embodiment, the tray 22 is formed from a template 90 of lightweight yet strong sheet of cardboard stock. Portions are cut and folded from the template 90 to form the tray 22 shown in FIG. 2 and portions held in place with adhesive or other conventional attachment systems.

Referring again to FIG. 1, the box 24 may include a window 26 along a front wall 28. The box 24 also includes sides 32 and ends 34. The ends include a flap 36 and tabs 38 that engage to define an enclosure. It is noted that the box 24 is described herein with the face having the window 26 as being the front, but that the box 24 may be oriented differently for different uses and be oriented differently during shipping and/or display. The open ends 34 allow for inserting the tray 22 supporting the candy canes 100 into the box 24 with the candy canes 100 displayed in a pleasing manner through the window 26, as explained hereinafter. The rectangular box 24 has a size and shape that accommodates the tray 22, which is rectangular when fully configured for supporting candy canes.

Figure 5:
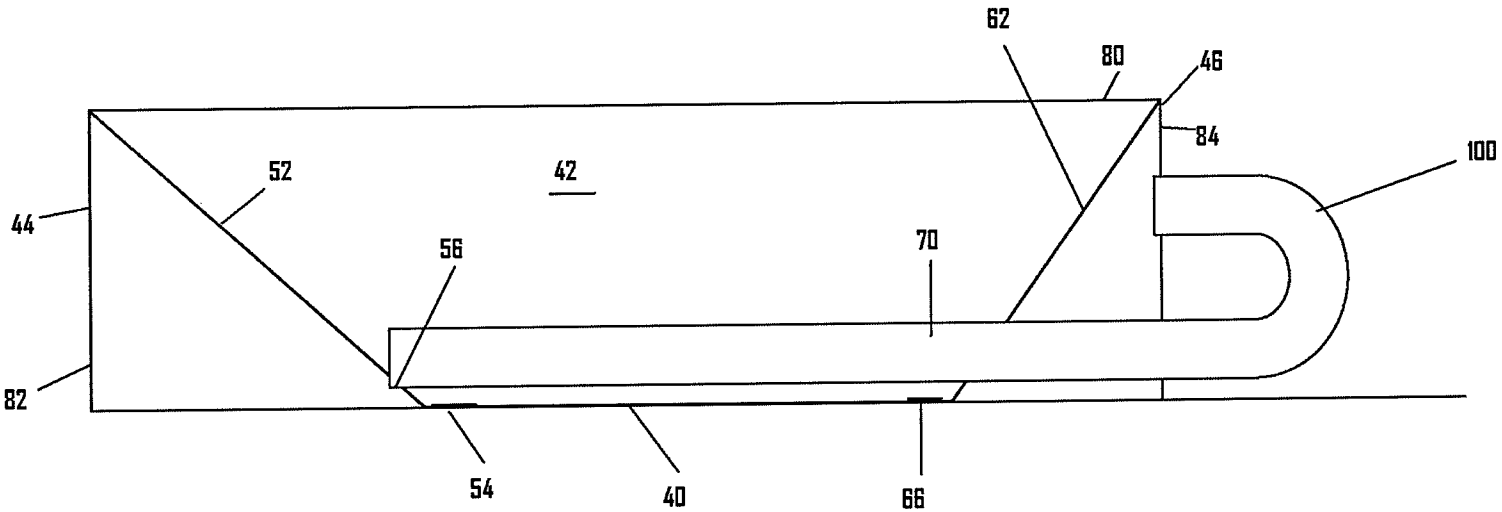
FIG. 5 is a side sectional view of the tray shown in FIG. 2 with candy partially inserted into the tray.

Referring now to FIGS. 2-6, the tray 22 includes a base 40, sides 42, a first end 44 and a second end 46. The second end includes a load window 64 and a hinged flap that covers the load window in a shipping configuration. The hinged flap 48 is opened to allow loading of the candy canes 100 through the load window 64, as shown in FIG. 5. Near the first end is a first support 50 including an angled section 52 supporting extreme ends of the straight portion 102 of the candy canes 100. The section 52 extends downward at an oblique angle to the base 40 and includes an engagement section 54 that may be attached, such as with adhesive, to the base 40. The section 52 includes one or more orifices 56 that receive ends of the candy canes that maintain the ends of the candy canes 100 spaced apart from the base of the tray 22 and from the walls of the box 24.

Figure 8:
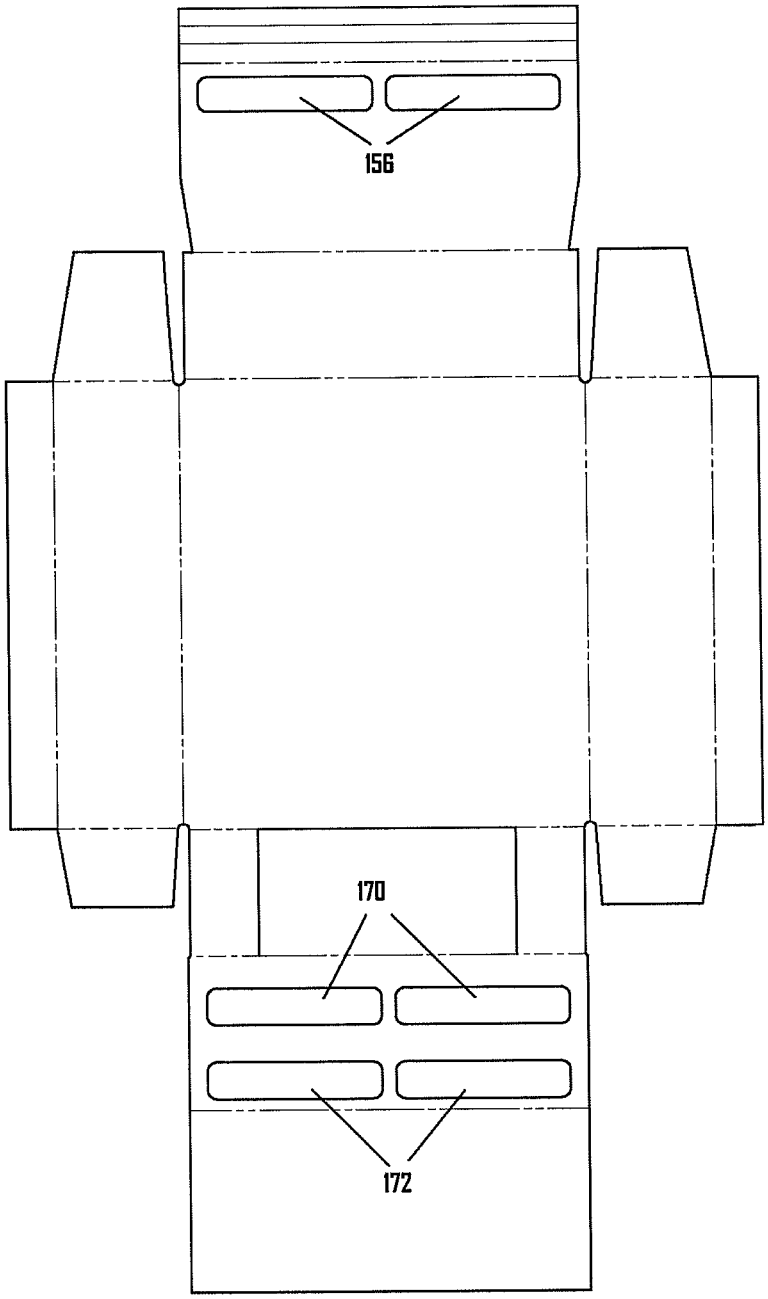
FIG. 8 is a top plan view of a template for a second embodiment of a tray according to the principles of the present invention.
Figure 9:
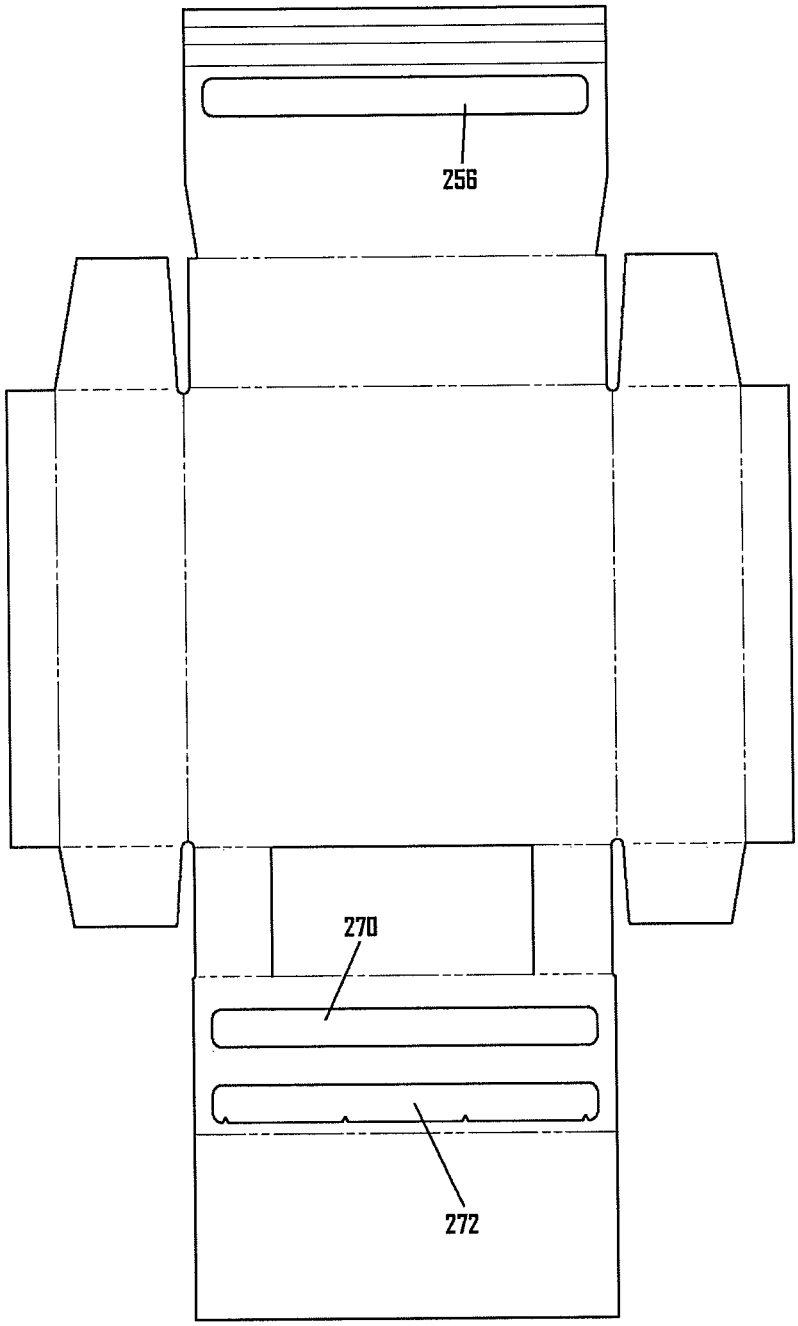
FIG. 9 is a top plan view of a template for a third embodiment of a tray according to the principles of the present invention.

In addition, the tray 22 forms a second support 60 near the second end 46. The second support 60 also includes an angled support section 62 and extends downward to the tray base 40. The second end 46 defines a load window 64 and a flap 48. The candy cane support section 62 leads down to a bottom engagement section 66 that may have adhesive applied to it for attachment to the tray base 40. The support section 62 includes second orifices 70 and third orifices 72. In a preferred embodiment, the second and third orifices 70 and 72 are of the same number as the first orifices 56 formed in the first support 50. The orifices 56, 70 and 72 are also aligned laterally so that candy canes are supported in parallel with one or more candy canes inserting into the orifices 56, 70 and 72 and being supported by the support sections 52 and 62. In the embodiment shown, the tray 22 includes three first orifices 56, three second orifices 70 and three third orifices 72. As shown in FIGS. 8 and 9, there may be different numbers of the orifices 156, 170 and 172 or 256, 270 and 272. In all embodiments, it is preferred that the first, second and third sets of orifices are laterally aligned for supporting candy canes in a longitudinal manner extending along the tray 40. In addition, it can be appreciated that each of the orifices must overlap laterally with at least a portion of the load window 64. In this manner, the candy canes may be slid directly from a second end 46 through the load window 64 and into the orifices 56, 70 and 72. It can be appreciated that once a candy cane 100 has been loaded in one of the sets of the outermost orifices 56, 70 and 72, the candy canes 100 may be slid outward and another candy cane 100 may be inserted until the sets of orifices are filled.

Figure 6:
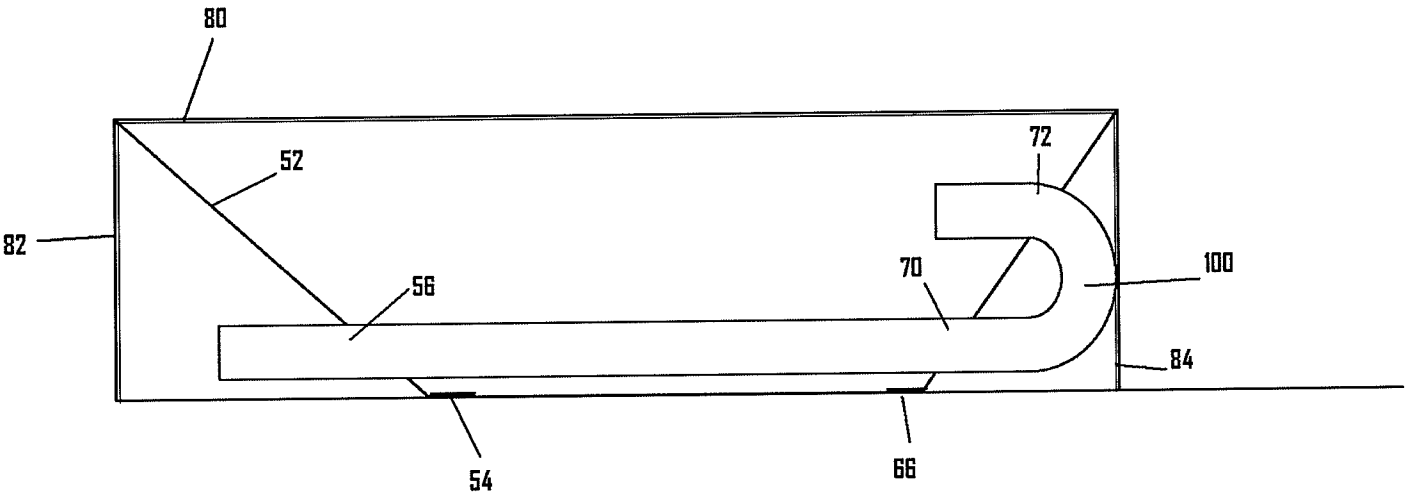
FIG. 6 is a side sectional view of the tray shown in FIG. 2 with candy retained in the tray.

As shown most clearly in FIGS. 5 and 6, the tray 22 also includes support portions providing reinforcement along selected edges and corners of the tray 22. Side reinforcements 80 extend along a top portion of each of the sides 42. First end reinforcements 82 extend inward from the corners at the first end 44 and second end reinforcements 84 extend inward at the corners of the second end 46.

It can be appreciated that the assembled tray 22 defines a retaining system with a first support 50 and second support 60 retaining and suspending the candy canes 100 so that they are spaced apart from the uppermost edge of the tray 22 and from the tray base 40. This provides protection and cushioning for the candy canes during shipment so that the candy canes are not broken or cracked during shipping.

Although the tray 22 is shown with oblique sections 52 and 62, it can be appreciated that the orifices 56, 70 and 72 could be formed in vertical walls or the orifices 70 and 72 could also be offset longitudinally in different wall portions depending upon how a template is folded. The orifices 56, 70 and 72 should be aligned to support the candy canes 100 in a spaced apart relationship to the walls and sides of the box 24. However, such variance and different embodiments may work well for some applications.

Figure 7:
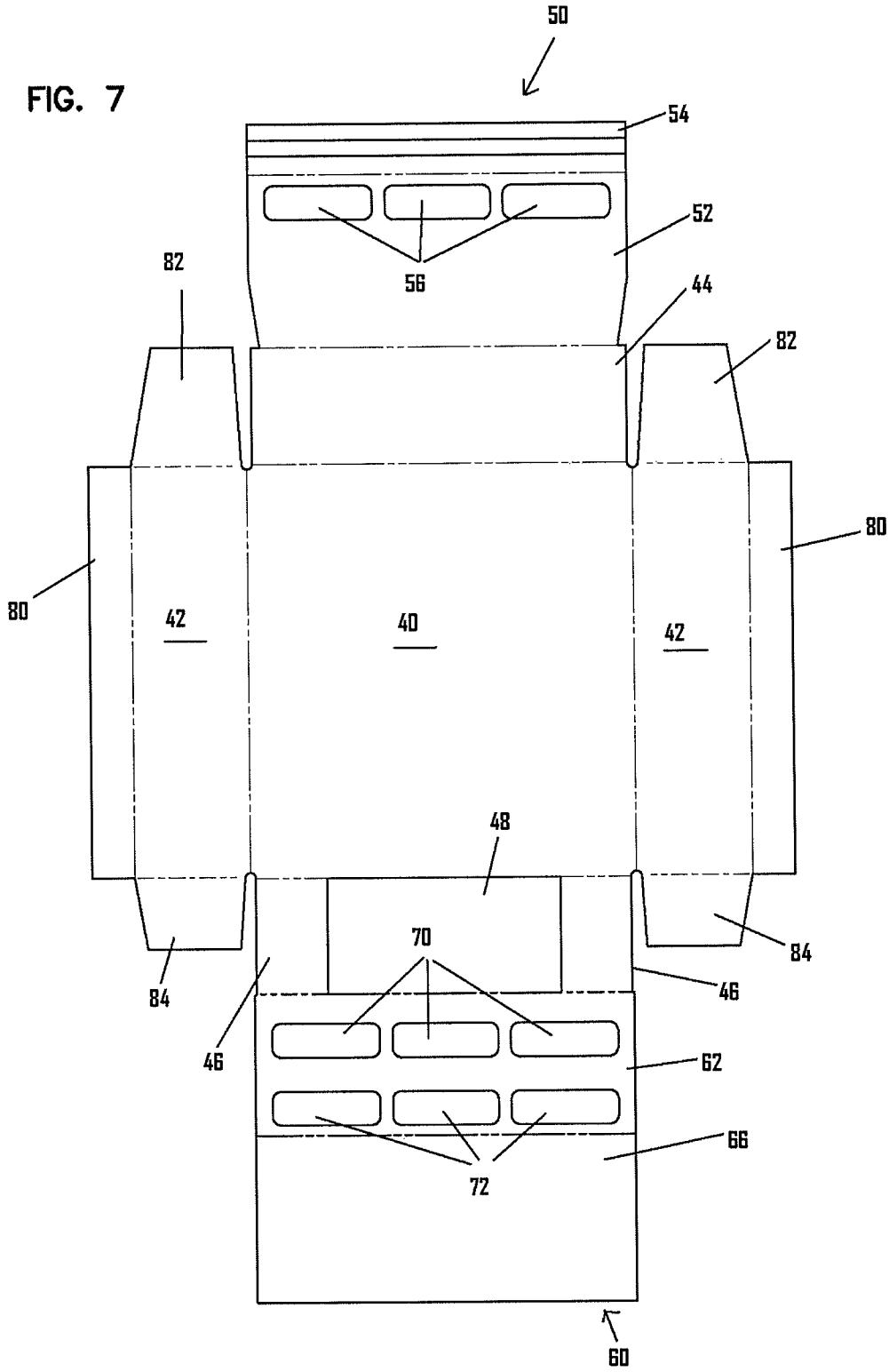
FIG. 7 is a top plan view of a template for the tray shown in FIG. 2.

Referring now to FIG. 7, a template 90 defines the tray base 40 with sides 42 extending laterally outward in opposite directions. From each of the sides 42 extend the first and second end reinforcements 82 and 84 while extending laterally are the side reinforcements 80. Fold lines 92 provide for creasing the sides to form the desired structure. Moreover, the template defines a first end 44 and the angled section 52 extending longitudinally outward from the first end 44. Orifices 56 are punched through the section 52 and bottom engagement 54 extends longitudinally outward from the support section 52. Fold and crease lines 92 define the edges of the first end 44, the support section 52 and the bottom engagement 54 as well as providing locations for applying adhesive or other attachment materials.

The template 90 also defines the second end 46 and includes fold and cut lines 94 that define the flap 48 and the load window 64. Fold and crease lines 92 also define the height of the second end 46. Extending longitudinally outward from the second end is the angled support section 62 having the orifices 70 and 72 punched out of the support section 62. Extending further longitudinally from the support section 62 is the bottom engagement section 66.

The template shown in FIGS. 8 and 9 are similar with the exception of different numbers and arrangements of the sets of orifices 156, 170, 172 and 256, 270 and 272 respectively. It can also be appreciated by those skilled in the art that other numbers of orifices may also be utilized.

When the template has been cut out, the sides and ends are folded upward with the support portions 80, 82 and 84 extending inward. The ends 44 and 46 are also folded up and the support sections folded down with the engagement section 54 and 66 attaching to the base 40 of the tray 22. A lightweight yet sturdy rectangular tray is therefore formed.

To load the tray 22, the flap 48 is lowered to open the load window 64, as shown in FIG. 5. The packaging 20 of the present invention provides for simple and quick loading of the candy canes into the tray 22. With the load window 64 open, the candy cane is simply inserted with the end of the straight portion inserting first into the second orifice 70 as shown in FIG. 6. The candy cane 100 is simply pushed straight inward towards the first end 40 of the tray 22 until the end of the straight portion 102 inserts into the orifice 56 and the uppermost portion of the hook 104 extends into the orifice 72. It is also possible to load multiple candy canes by sliding them together in a side-by-side relationship. Moreover, the outermost orifices 70 align with the window so that a candy cane 100 is pushed straight inward until fully engaged as shown in FIG. 6. The candy canes 100 in the outermost sets of orifices 56, 70 and 72 may then be slid outward and another candy cane 100 inserted until the width of the orifices 56, 70 and 72 are completely filled with candy canes 100. When the tray 22 is full with candy canes 100, the flap 46 is pushed upward and the tray 22 may be slid into an end 34 of the box 24. The box flap 36 and tabs 38 may then be closed to provide a candy cane packaging 20 that supports the candy canes 100 away from the walls 28 and 30 and sides 32 of the box 24. Alternatively, the tray may be covered in a shrink wrap or other film.

Moreover, it can be appreciated that the open top of the tray 22 is aligned with the window 26 of the box 24. The candy canes are displayed in full view through the open top of the tray 22 and can be viewed through the window 26 of the box 24 or through the film covering.

It can be appreciated that the packaging 20 provides for a support tray 22 that is inexpensive and easy to manufacture and assemble. Moreover, the packaging 20 provides a tray 22 that is quickly and easily loaded with candy canes 100. The packaging 20 also provides for suspending the candy canes 100 to minimize the likelihood of the candy canes 100 being broken during loading and shipping. Moreover, the candy canes 100 are displayed in an improved manner for the end consumer. Graphics may be applied to the box and/or tray to enhance the presentation.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A candy cane packaging system, comprising:

a plurality of candy canes, each of the plurality of candy canes having a straight portion having an end, and a hook portion;

a box having a front wall, a rear wall, opposed sides, a first end and a second end, the box having an opening at the first end, the plurality of candy canes inserted through the opening at the first end of the box with the end of the straight portion first to define an insertion direction extending away from the first end and the opening;

a support device inserted into the box through the opening along the insertion direction and extending between the opposed sides configured for receiving the plurality of candy canes slid through the opening into engagement with the support device, the support device including:

a cross portion parallel to and spaced apart from the front wall and the rear wall and perpendicular to the insertion direction, the support device supporting the plurality of candy canes in an unobstructed side by side arrangement with the hook portions of the plurality of candy canes extending around the cross portion, and the cross portion retaining the straight portions of the plurality of candy canes intermediate the rear wall and the cross portion.

2. A method of packaging a plurality of candy canes, each of the plurality of candy canes having a straight portion and a hook portion, the method comprising:

providing a box having a front wall, a rear wall, opposed sides, a first end and a second end, the box having an opening at the first end;

providing a support device inserting into the box through the opening and extending between the opposed sides, the support device including:

a cross portion parallel to and spaced apart from the front wall and the rear wall and defining a space behind the cross portion configured for receiving the plurality of candy canes, sliding the plurality of candy canes through the opening at the first end of the box and into the support device with straight portions of the plurality of candy canes inserting through the space behind the cross portion of the support device with the support device supporting the plurality of candy canes with the hook portions of the plurality of candy canes extending over the cross portion of the support device, and retaining the straight portions of the plurality of candy canes in the space behind the cross portion of the support device.

3. The method of packaging a plurality of candy canes according to claim 2, the support device supporting the plurality of candy canes in unobstructed side by side arrangement with the hook portions of the plurality of candy canes extending over the cross portion, and with the cross portion retaining the straight portions of the plurality of candy canes.

4. A candy cane packaging system according to claim 1, wherein the front wall has an opening formed therein exposing at least a portion of the plurality of candy canes.

5. A candy cane packaging system according to claim 1, wherein the cross portion is spaced a first distance from the open end of the box and the wherein the support device includes a second cross portion spaced a second distance from the open end of the box greater than the first distance.

6. A candy cane packaging system according to claim 1, wherein the candy canes are positioned in a side by side unobstructed arrangement abutting adjacent candy canes.

7. A method according to claim 2, wherein the candy canes are slid through the opening with ends of the straight portions first and the hook portions trailing.

8. A method according to claim 2, wherein at least some of the plurality of candy canes the candy canes are slid through the opening positioned in a side by side unobstructed arrangement.

* * * * *